US005857406A

United States Patent [19]

Scheucher et al.

[11] Patent Number: 5,857,406

[45] Date of Patent: Jan. 12, 1999

[54] SCREW PRESS FOR SEPARATING LIQUIDS FROM SOLID-LIQUID MIXTURES

[75] Inventors: Peter Scheucher, Albersdorfweg; Rudolf Stadlauer, Am Kornfeld, both of Austria

[73] Assignee: Andritz-Patentverwaltungs-Gesellschaft m.b.H., Graz, Austria

[21] Appl. No.: 837,783

[22] Filed: Apr. 22, 1997

[30] Foreign Application Priority Data

Apr. 25, 1996 [AT] Austria ..... 749/96

[51] Int. Cl.[6] ..... B30B 9/14

[52] U.S. Cl. ..... 100/112; 100/117; 100/127; 100/145

[58] Field of Search ..... 110/112, 117, 110/126–128, 145

[56] References Cited

U.S. PATENT DOCUMENTS

| | | | |
|---|---|---|---|
| 3,126,818 | 3/1964 | Koelsch | 100/112 |
| 4,446,788 | 5/1984 | Molnar | 100/128 |

FOREIGN PATENT DOCUMENTS

| | | | |
|---|---|---|---|
| 1328822 | 4/1963 | France | 100/145 |
| 610396 | 3/1935 | Germany | 100/145 |
| 240171 | 10/1986 | Germany | 100/145 |
| 57-94493 | 6/1982 | Japan | 100/117 |
| 48193 | 7/1930 | Norway | 100/145 |
| 71056 | 12/1946 | Norway | 100/145 |
| 357873 | 10/1931 | United Kingdom | 100/145 |

*Primary Examiner*—Stephen F. Gerrity
*Attorney, Agent, or Firm*—Alix, Yale & Ristas, LLP

[57] ABSTRACT

A screw press for separating liquids from solid-liquid mixtures, especially pulp suspensions, which has a casing 2 provided with liquid passages, especially divided into segments 3, 3', as well as having a screw 4 rotating inside the casing, a shaft 5, preferably hollow, and a suspension feed area 6. It is primarily characterized by the suspension feed area 6 extending lengthwise in an axial direction on the screw casing 2 with the length and position of the feed opening being adjustable.

13 Claims, 4 Drawing Sheets

SCREW PRESS FOR SEPARATING LIQUIDS FROM SOLID-LIQUID MIXTURES

BACKGROUND OF THE INVENTION

The invention relates to a screw press for separating liquids from solid-liquid mixtures, especially pulp suspensions, which has a casing provided with liquid passages, the casing especially divided into segments, and having a screw mounted on a shaft, which is preferably hollow, rotating inside the casing, and including a suspension feed area.

When dewatering suspensions with low consistencies, it is only possible to achieve good dewatering performance in the inlet area of a screw press at very low pressures. At higher pressure, the stock, particularly a pulp suspension, is pushed onto the openings in the screen from the inside and thus plugging openings and impeding the dewatering action. After the first rise in pressure, the filtrate no longer flows out of all the holes in the screen, but only out of those that have just been cleared by the rotating screw flight moving past. If the pressure rises further, the screw flight cannot clean the screen at all because of the required gap between flight and screen unless there are already drier pulp fibers upstream of the flight which bridge the gap. The clogged screen surface is then lost for dewatering purposes. In the pulp distribution boxes already known and which are located at the beginning of the screw, the screen basket starts to clog as the pressure rises from the beginning of the screw towards its end.

SUMMARY OF THE INVENTION

The aim of the invention is to create a screw press which is suitable for suspensions with low inlet consistencies and which yields high dewatering performance.

It is, therefore, characterized by the suspension feed area being changeable in its position and/or its length. This provides the possibility of adapting the suspension feed area to the required dewatering conditions when the pulp feed conditions have changed.

A favorable further development of the invention is characterized by the suspension feed area extending over several segments of the casing. If the suspension feed area, which can take the form of a slit, is at the top and extends over several casing segments, which are also referred to as screen baskets, there is uniform screw filling over a greater length and even better pressure distribution.

An advantageous further development of the invention is characterized by the suspension feed area only beginning at a casing segment located some distance from the beginning of the screw, viewed in the transport direction of the suspension. If the active suspension feed area, i.e. the open feed cross-section, does not begin until after the first sector at the beginning of the screw, the pulp fed must flow against the transport direction in the screw passage between the flights. Due to the resulting loss of pressure, very slight pressure is applied at the beginning of the screw which causes dewatering to take place in this area even if some downstream screen openings are plugged. Thus, drier fibers are produced right at the beginning of the screw and these drier fibers assist in clearing the screen right from the beginning.

A favorable configuration of the invention is characterized by the individual casing segments of the screw being interchangeable. Since these segments are interchangeable and since they may or may not contain suspension feed openings, the position and also the length of the suspension feed area can be adapted ideally to the required dewatering conditions by including more or fewer casing segments having feed openings or by having replaceable casing segments having varying sizes of feed openings. This provides a simple means of adapting the suspension feed to changes in pulp feed conditions at short notice and without long shutdowns if conditions fluctuate substantially.

A further favorable configuration of the invention is characterized by the inlet slit to the suspension feed area being fitted with at least one element for modifying the open feed cross-section, which can take the form of a gate valve. Panels can also be inserted in this sector or flaps can be used. In this way, it is possible to change the position and the length of the suspension feed slit within certain limits even more easily and quickly. Thus, adaptations to accommodate slight changes or fine adjustments to meet the pulp feed conditions can be achieved even more effectively.

A favorable configuration of the invention is characterized by the screw having elastic elements which form scrapers at the beginning of the screw flights on its outer circumference and which can be mounted on the screw flight or directly upstream of the screw flight. This is a particularly good way of bridging the gap between the screw flight and the casing (screen basket) and thus, of achieving good dewatering right at the beginning of the screw, with the screen surface being cleared regularly for dewatering.

In an advantageous further development of the invention, at least one filtrate tray, which may have filtrate overflows, is provided under the screw casing. In screw presses with a large diameter, the pressure on the lower side of the screen is higher due solely to the height difference. This difference in pressure can be compensated easily by submersion in a filtrate tray. If the filtrate tray is divided into zones with different heights of filtrate overflows, the pressure progression can be adjusted particularly well to the required dewatering pressures.

DESCRIPTION OF THE PREFERRED EMBODIMENTS

Figure 1:
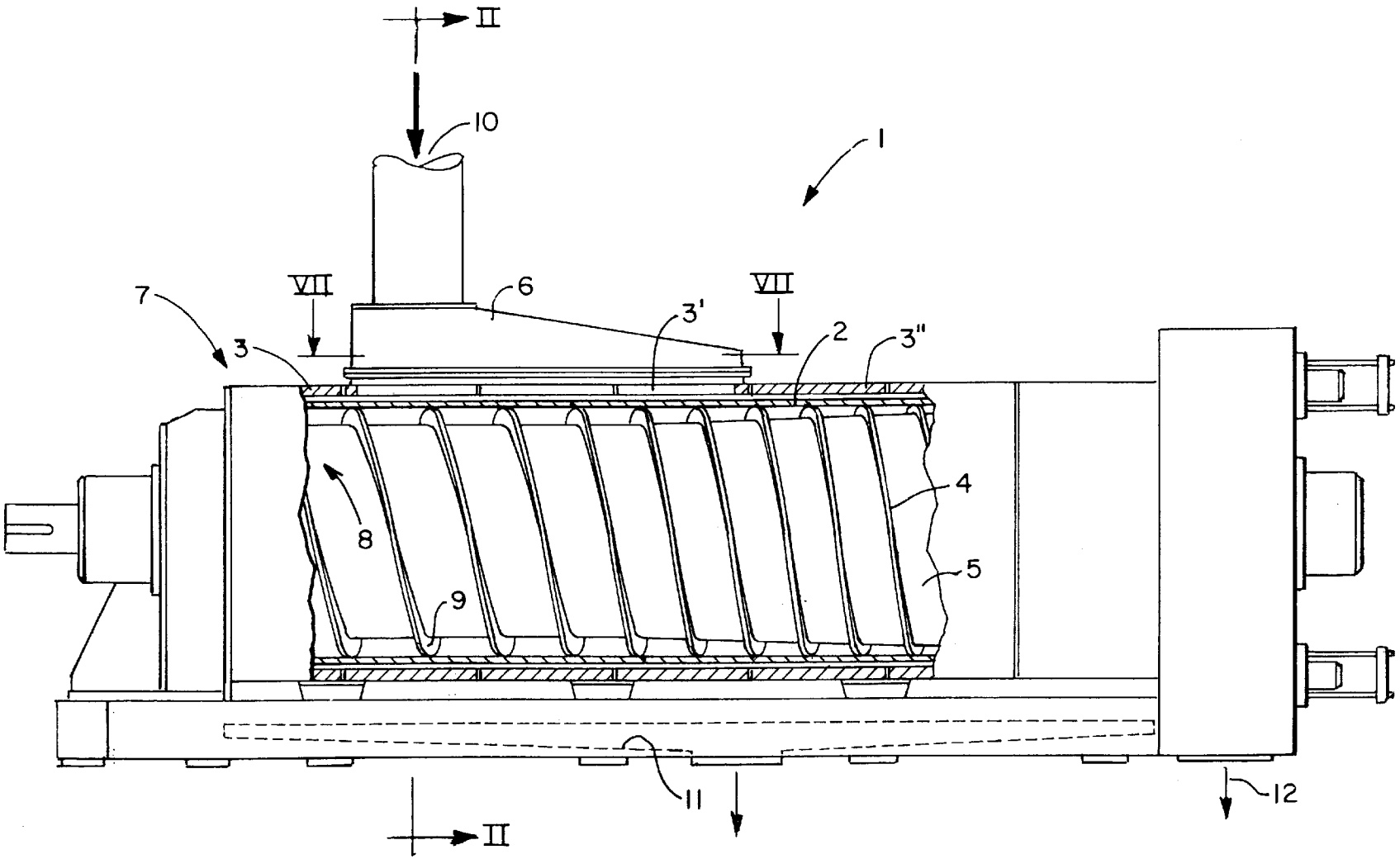
FIG. 1 shows a screw press according to the invention.

FIG. 1 shows a screw press 1 with a casing 2, which is divided into segments 3, 3' and 3". A screw 4 mounted on a shaft 5, which is preferably hollow, rotates inside this casing 2. The suspension, e.g. pulp suspension, is fed to the screw press 1 through a suspension feed area 6. This suspension feed area 6 is designed as a distribution box, which extends over three casing segments 3' in the variant shown. This top suspension feed area 6, which can take the form of a slit, thus permits the even or uniform filling of the screw 4 over a considerable length and as a result, even better distribution of pressure. The suspension feed area 6 with the casing segments 3' allocated to it does not start right at the beginning 7 of the screw, but a little further on in the conveying direction. Thus, there is at least one casing segment 3 without a feed opening at the beginning 7 of the screw. As a result, the pulp fed must flow against the transport direction in the passage 8 between the screw flight, i.e., to the left in FIG. 1. Due to the resulting loss of pressure, very slight pressure is applied at the beginning 7 of the screw which causes dewatering to take place in this area in any event. Thus, drier fibers are produced here right at the beginning 7 of the screw upstream of the screw flight 9 which clears the screen. In order to adapt the screw press 1 better to the operating conditions, the casing segments 3, and 3' are interchangeable so that a suitable point can always be found for the suspension feed.

Since these segments 3, 3' are interchangeable, both with suspension feed openings as in 3' and without suspension feed openings as in 3, the position and also the length of the suspension feed area 6 can be adapted ideally to the required dewatering conditions. This also provides a simple means of adapting the suspension feed to changes in pulp feed conditions at short notice and without long shutdowns if these conditions fluctuate substantially.

The pulp suspension enters the distribution box (pulp feed area) 6 at 10. The water draining off through the casing 2 during dewatering is collected in a filtrate tray 11 and drained off from there. The dewatered pulp leaves the screw press 1 at the pulp discharge 12.

Figure 2:
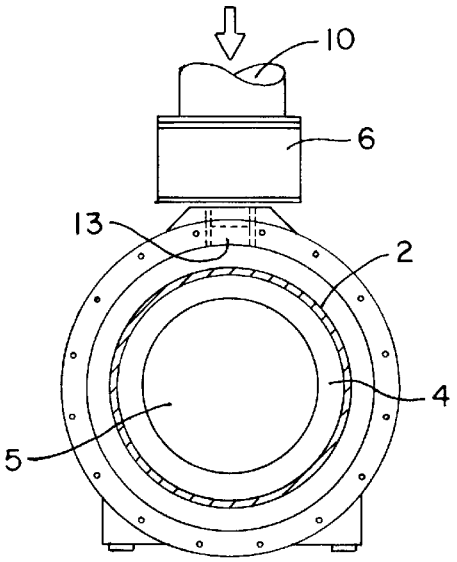
FIG. 2 shows a sectional view across the line marked II—II in FIG. 1.

FIG. 2 shows a cross-section through the line marked II—II in FIG. 1. The pulp from the distribution box (pulp feed area) 6 is fed in at casing segment 3' through a slit 13 which extends right through the casing 2.

Figure 3:
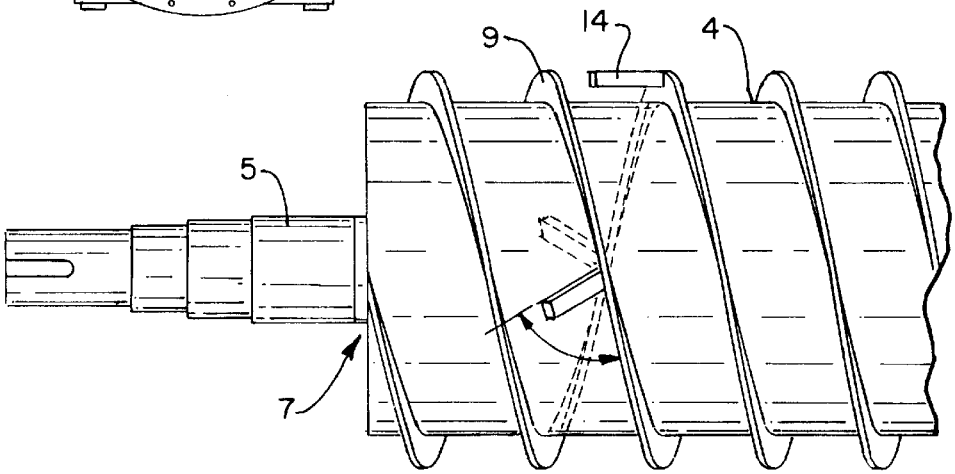
FIGS. 3 and 3*a* show a variant of the invention involving the use of scrapers.
Figure 3A:
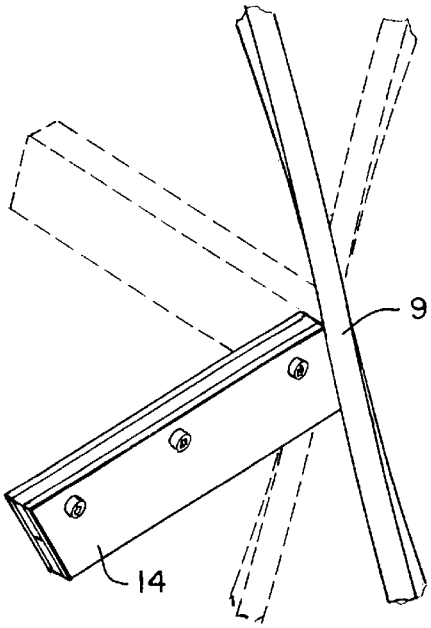

FIG. 3 shows a variant of the screw 4 where scrapers 14 are mounted on the screw flight 9 and form an angle, preferably around 70°, with the screw flight 9, with several scrapers 14 being provided at the beginning 7 of the screw. In the case of the double screw flights shown, this applies to both flights. FIG. 3*a* shows a detail illustrating the mounting for the scraper 14 on the screw flight 9.

Figure 4:
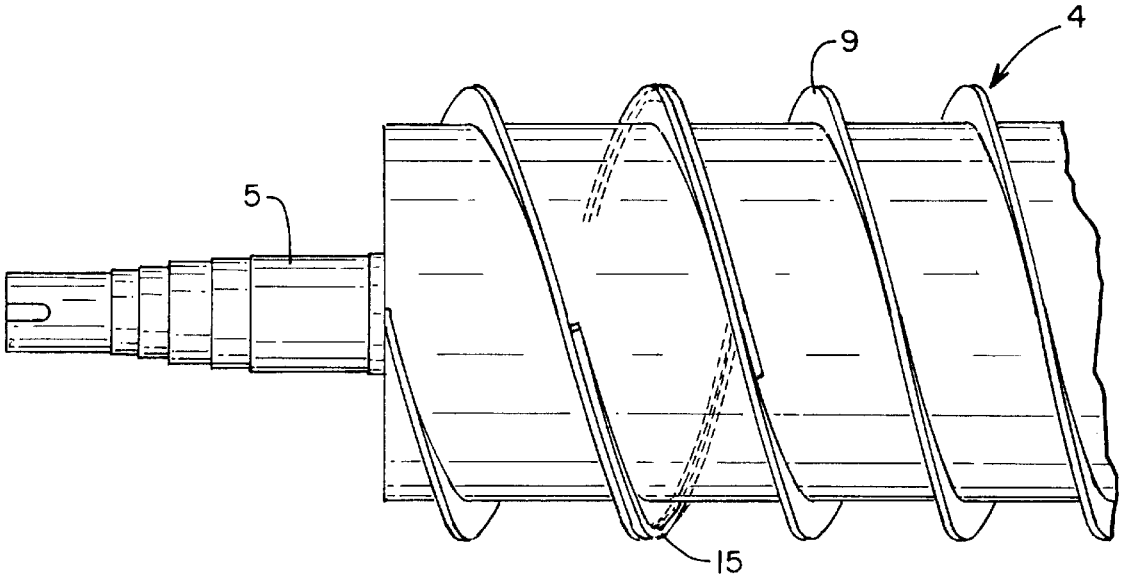
FIGS. 4 and 4*a* show a further variant for the screw of the invention.
Figure 4A:
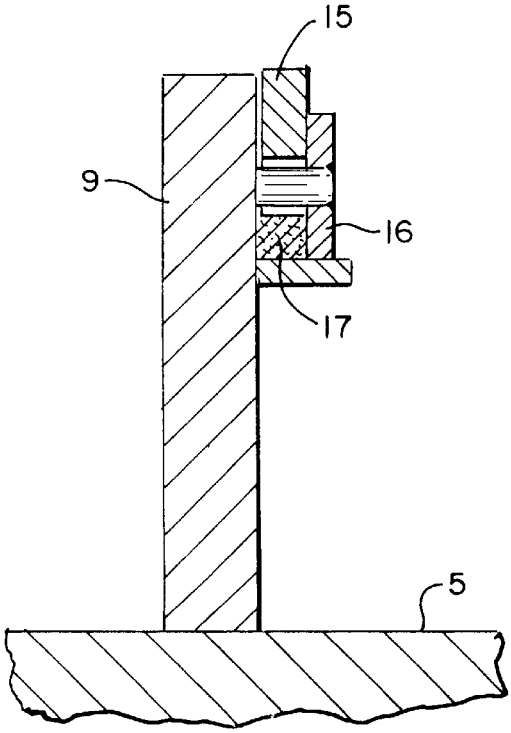

FIGS. 4 and 4*a* show an alternative form of scraper 15, which is mounted directly upstream of the screw flight 9. Here the scraper 15 is held by a metal plate 16 and pressed onto the casing 2 with some yield by a sealing ring 17.

Figure 5A:
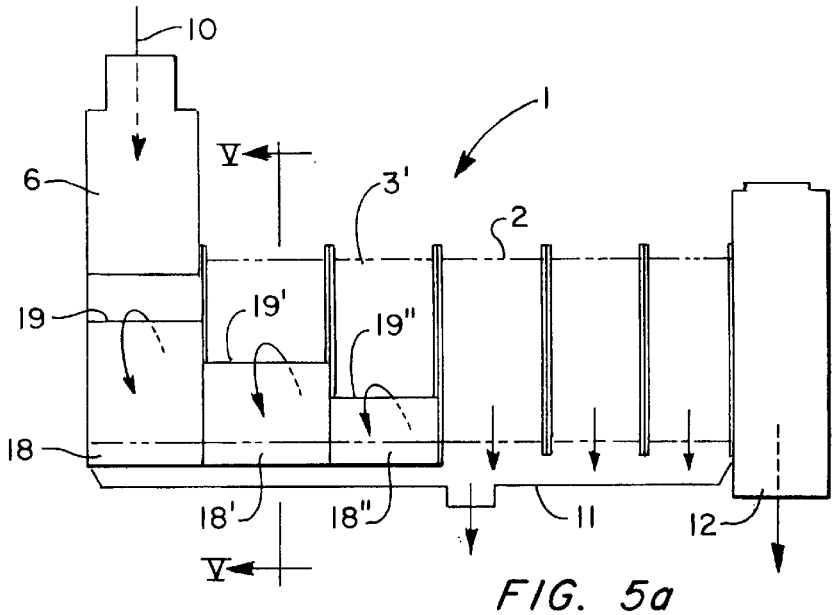
FIGS. 5*a* and *b* also show a variant of the invention using filtrate trays.
Figure 5B:
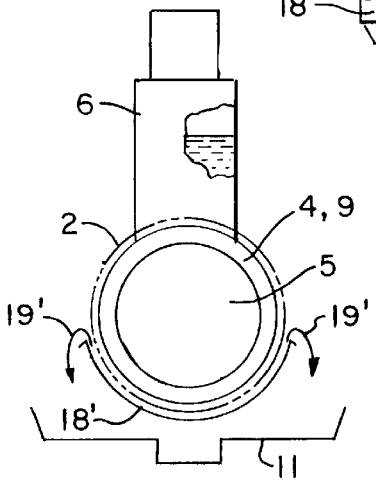
Figure 6A:
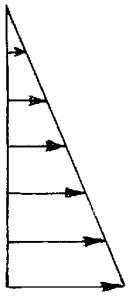
FIGS. 6*a, b* and *c* illustrate the pressure progression according to FIG. 5*b*.
Figure 6B:
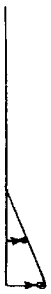
Figure 6C:
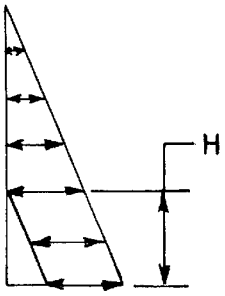

FIG. 5*a* contains a schematic diagram of a screw press 1 with a casing 2 and pulp feed area 6, as well as a pulp outlet. 12. In this variant, the water pressed out is drained first of all into filtrate trays 18, 18' and 18", from which it reaches the filtrate tray 11 through filtrate overflows 19, 19' and 19". In screw presses with a large diameter, the pressure on the lower side of the screen 2 is higher due solely to the height difference. This difference in pressure can be compensated easily by submersion in the filtrate trays 18, 18', 18". The pressure progression according to the design in FIG. 5*b*, which shows a section through the line marked V—V in FIG. 5*a*, is shown in FIG. 6*a, b* and *c*. FIG. 6*a* illustrates the inner pressure applied due to the difference in height. FIG. 6*b* shows the counter-pressure obtainable in the filtrate tray 18'. FIG. 6*c* then shows the differential pressure to be set, clearly indicating that a constant differential pressure results due to the counter-pressure generated in the filtrate tray 18' in the sector marked H. which corresponds to the height of the filtrate tray 18'.

Figure 7:
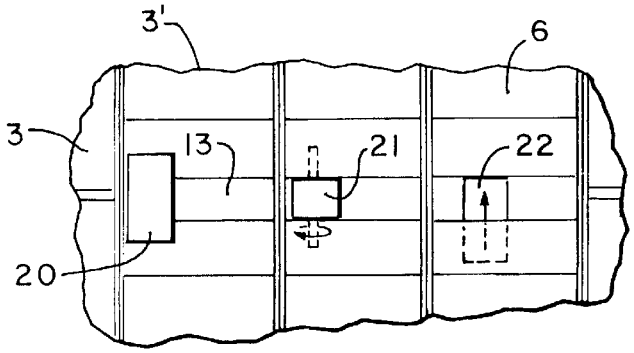
FIG. 7 shows a section through VII—VII shown in FIG. 1.

FIG. 7 shows a section through the line VII—VII in FIG. 1 and shows various configurations of elements used to narrow the cross-section in the pulp feed area 6. Here it is possible to use either metal plates 20 to cover the slit 13, rotary flaps 21 for setting the open cross-section or gate valves 22. In this case it is possible to use either single elements to alter the cross-section or several of the same type or several different types of element.

We claim:

1. A screw press for separating liquids from solid-liquid mixtures comprising a casing having liquid flow passages therethrough, a screw having upstream and downstream ends rotating inside of said casing for conveying said solid-liquid mixture through said casing in a transport direction and forcing liquid through said liquid flow passages and solid-liquid mixture feed means for feeding said solid-liquid mixture into said casing through a feed opening wherein said casing comprises a plurality of casing segments and wherein at least one of said casing segments contains said feed opening and wherein said casing segments are interchangeable to change the position of said feed opening.

2. A screw press as recited in claim 1 wherein said solid-liquid mixture feed means extends over at least two of said casing segments.

3. A screw press as recited in claim 2 wherein said solid-liquid mixture feed means is located at a distance downstream from the upstream end of said screw.

4. A screw press as recited in claim 2 wherein said screw includes an outer circumference and elastic scraper elements attached to said screw on said outer circumference to clean said liquid flow passages.

5. A screw press as recited in claim 1 wherein said solid-liquid mixture feed means is located at a distance downstream from the tupstream end of said screw.

6. A screw press as recited in claim 1 wherein at least one of said feed openings in said casing segments includes means for modifying the size of said feed opening.

7. A screw press according to claim 6 wherein said solid-liquid mixture feed means is located at a distance downstream from the upstream end of said screw.

8. A screw press as recited in claim 6 wherein said means for modifying the size of said feed opening comprises a gate valve.

9. A screw press as recited in claim 1 wherein said screw includes an outer circumference and elastic scraper elements attached to said screw on said outer circumference to clean said liquid flow passages.

10. A screw press as recited in claim 1 wherein at least one filtrate tray is provided below said casing.

11. A screw press as recited in claim 10 wherein there are a plurality of filtrate trays and said filtrate trays have filtrate overflows.

12. A screw press as recited in claim 11 wherein said filtrate trays each have filtrate overflows at different heights.

13. A screw press for separating liquid from a pulp-liquid mixture comprising:

a. a cylindrical casing having a plurality of liquid passages through the sides thereof thereby forming a screening structure, said casing being divided into a plurality of interchangeable cylindrical segments;

b. a conveying screw mounted inside said cylindrical casing and including means for rotating said conveying screw to convey said pulp-liquid mixture through said casing and forcing liquid out through said plurality of liquid passages;

c. a feed area for feeding said pulp-liquid mixture into said casing, said feed area including a slit through the side of at least one of said cylindrical segments; and d. means for changing the position of said feed area with respect to said cylindrical casing including means for interchanging some of said cylindrical segments.

* * * * *